US006154887A

United States Patent [19]

Yagi

[11] Patent Number: 6,154,887

[45] Date of Patent: Dec. 5, 2000

[54] HEADGEAR

[75] Inventor: Hiroshi Yagi, Sayama, Japan

[73] Assignee: Daiwa Seiko, Inc., Japan

[21] Appl. No.: 09/337,690

[22] Filed: Jun. 22, 1999

[30] Foreign Application Priority Data

Jun. 23, 1998 [JP] Japan ..... 10-175860

[51] Int. Cl.[7] ..... A42B 7/00

[52] U.S. Cl. ..... 2/175.7; 2/175.6

[58] Field of Search ..... 2/175.7, 175.6, 2/175.1, 195.1, 209.12

[56] References Cited

U.S. PATENT DOCUMENTS

| | | | |
|---|---|---|---|
| 701,639 | 6/1902 | Stamm | 2/175.7 |
| 815,714 | 3/1906 | Keator | 2/175.7 |
| 867,814 | 10/1907 | Fornander | 2/175.7 |
| 903,037 | 11/1908 | Westlund | 2/175.7 |
| 2,686,917 | 8/1954 | Auerbach | 2/175.7 |
| 5,675,841 | 10/1997 | Jackson | 2/175.7 |

FOREIGN PATENT DOCUMENTS 9-188914 7/1997 Japan .

*Primary Examiner*—Bibhu Mohanty
*Attorney, Agent, or Firm*—Pennie & Edmonds LLP

[57] ABSTRACT

A headgear which includes a crown put on a head and having an insertion through portion, and a headgear blow-away preventing device including a connection member having one end provided with a clip clipped to a wear. The other end of the connection member has a stopper mechanism for avoiding the connection member from falling out of the insertion through portion of the crown.

6 Claims, 4 Drawing Sheets

HEADGEAR

BACKGROUND OF THE INVENTION

The present invention relates to a headgear used, for example, in fishing, golf and the like, and more specifically to a headgear which cannot be blown away by wind.

In fishing, golfing or the like, a headgear such as cap or hat is used to avoid sun light and protect the head. Such a headgear is in many cases equipped with a strap so that the headgear is not blown away when worn in a windy situation. A conventional strap which is used for a cap is made of a soft resin or woven cloth and formed into a short band shape with clips (stoppers) provided at both ends thereof. One of the clips is clipped onto the rear side of the cap, and the other clip is clipped onto the collar of the wearer.

Jpn. Pat. Appln. KOKAI Publication No. 9-188914 has proposed a headgear blow-away preventing device as shown in FIGS. 1 to 3, for preventing a hat from being blown away by wind. The blow-way preventing device 1 has a hat clip portion 3, a broach-like wear clip portion 5 and a chain-like connecting member 7 detachably connected between these clips 3 and 5.

The clip 3 has such a structure that it is divided when a pin 3*b* is removed from a pin hole 3*a* as shown in FIG. 2. With this structure, the headgear blow-away preventing device 1 is used such that the clip portion 3 is clipped to a brim 9*a* and the wear clip portion 5 is clipped to a collar 11*a* of a wear 11 as shown in FIG. 3. The connection member 7 is connected between the clip portions 3 and 5, and therefore even if the hat 9 is removed from the head by wind, it will not be blown away.

However, the strap (headgear blow-away preventing device) such as described above is a separate structure from the cap or hat, and therefore it is possible that the strap is lost while it is not in use, or forgot to be brought to the fishing spot, golf course or the like.

Further, when it is not windy, the strap (headgear blow-away preventing device), which is not necessary when not windy, hangs down and comes in sight, which is very obstructive.

BRIEF SUMMARY OF THE INVENTION

The object of the present invention is to provide a headgear having a headgear blow-away preventing device for preventing the headgear from being blown away by wind, and more specifically to a headgear having a headgear blow-away preventing device which cannot be easily lost, or is not obstructive when it is not used, but which is also fashionable.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

FIGS. 4 to 7 show a cap, which is an embodiment of the headgear according to the present invention. As can be seen in these figures, a cap 12 has a crown 15 to put on the wearer's head, which is made by sewing together six material cloth pieces each cut to have substantially a triangle shape. As in the case of a conventional cap, a sunshade 17 is mounted to a front lower edge section of the crown 15. Further, an adjuster 19 is mounted to a rear lower edge section of the crown for adjusting the size of the cap.

Figure 5:
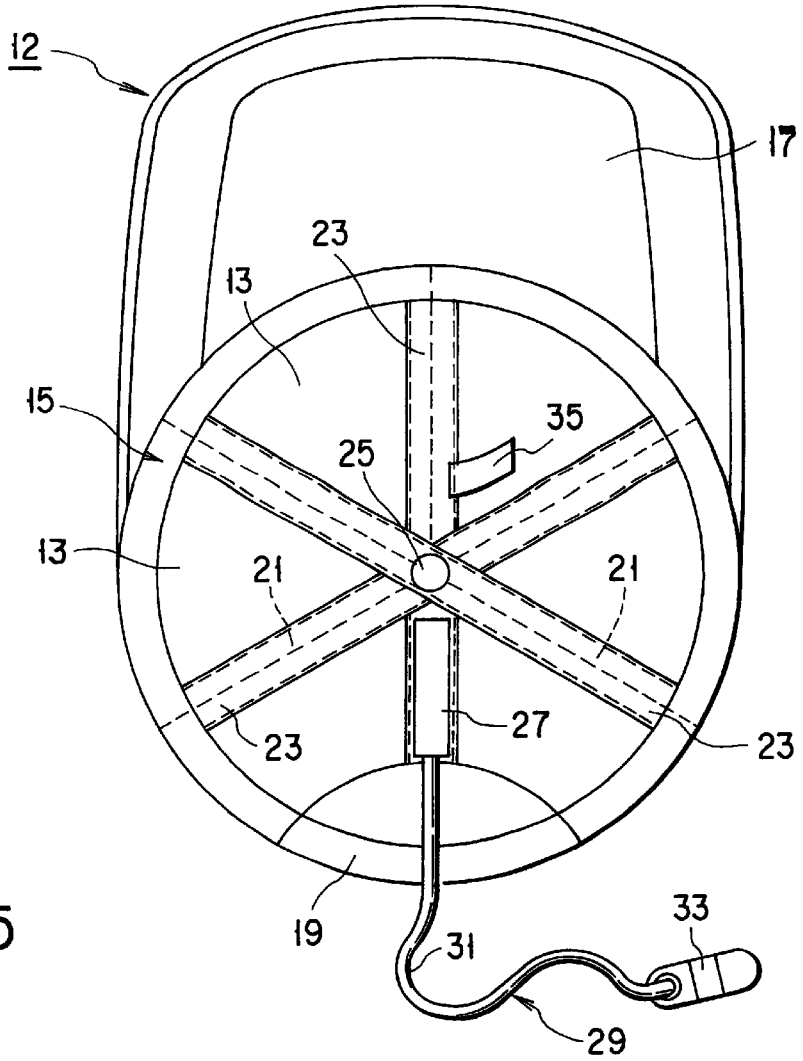
FIG. 5 is a view illustrating the cap shown in FIG. 4 when viewed from the bottom side, while the headgear blow-away preventing device is used.

As shown in FIG. 5, inside the crown 15, three tapes 23 are stitched along the seams of the material cloth pieces 13 to cross a top button 25 mounted at the central portion of the crown 15 in the front to back direction and in the right and left diagonal directions. The tapes 23 serve to maintain the shape of the crown 15.

Figure 6:
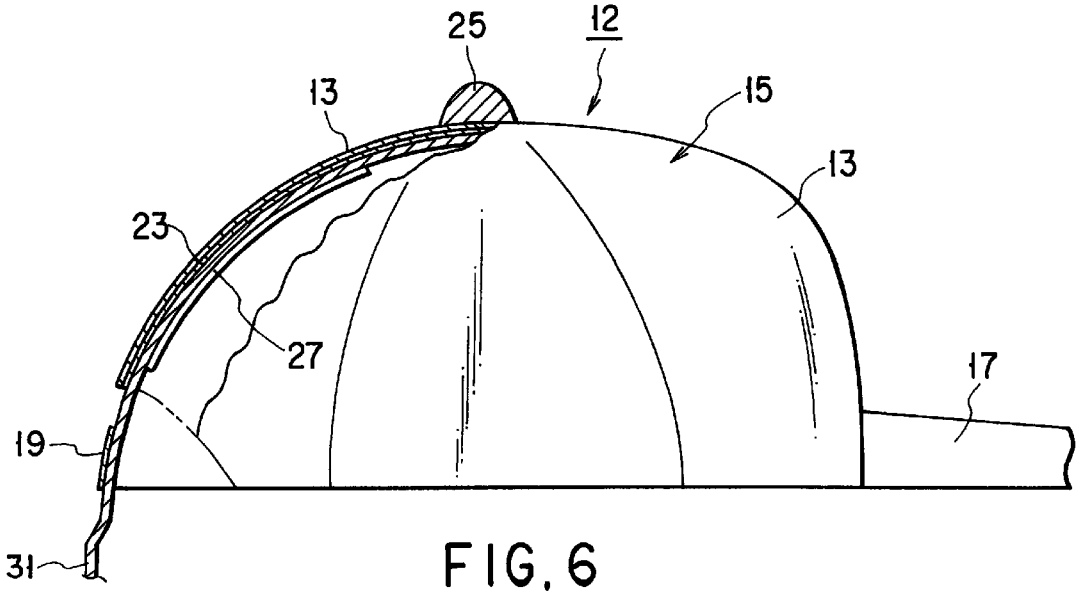
FIG. 6 is a partially cutaway lateral view showing the main portion of the cap shown in FIG. 4.
Figure 7:
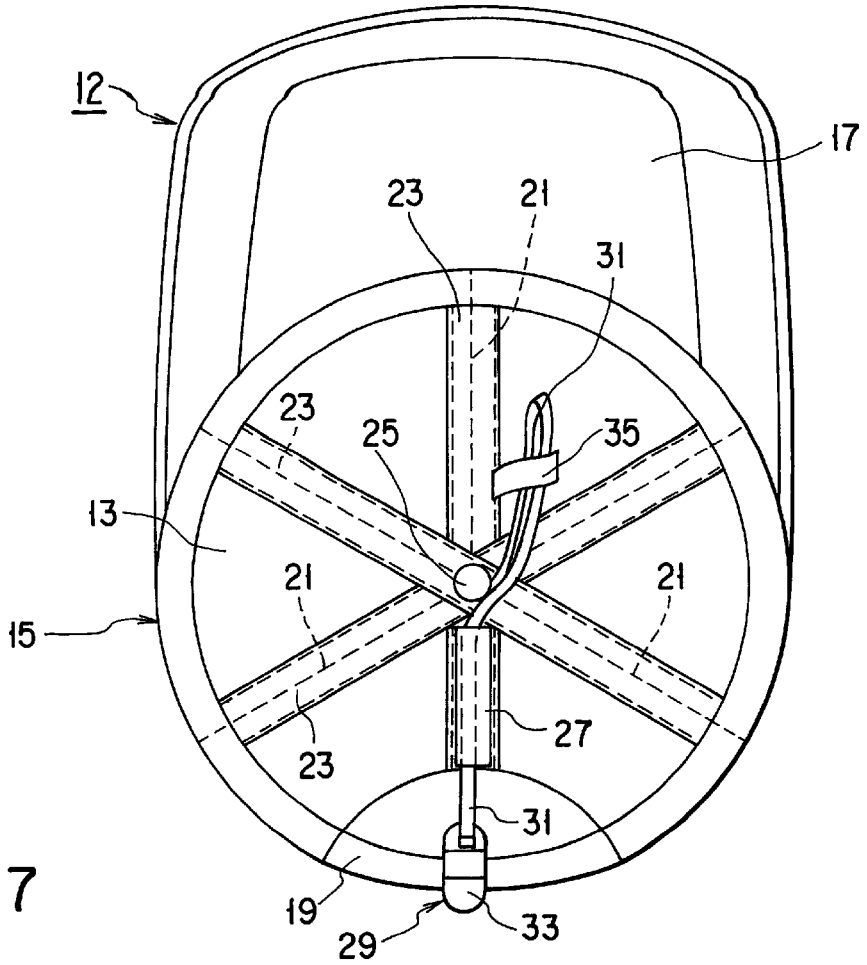
FIG. 7 is a view illustrating the cap shown in FIG. 4 when viewed from the bottom side, while the headgear blow-away preventing device is not used.

On the tape 23 directed towards the rear section of the crown 15 (in the direction towards an adjuster 19) from the top button, a cylindrical insertion through portion 27, which should preferably be made of the same material as that of the tape 23 and has an ellipsoidal cross section, is stitched, and the connection member of a head gear blow-away preventing device 29, which will be later explained, is put through the insertion through portion 27 as can be seen in FIGS. 6 and 7.

The headgear blow-away preventing device 29 includes a connection member 31 made of a cloth string having one end fixed to the top button 25 of the crown and the other end provided with a clip (stopper member) 33 clipped onto the collar of the wearer. The connection member 31 has such a length that the clip 33 can be hooked onto the collar 37 of the wearer when the connection member is stretched.

Inside the crown 15, a fastener (holding member) 35 which can hold the connection member by, for example, clipping or by friction, is provided. When the headgear blow-away preventing device 29 is not used, the connection member 31 is pulled in and fastened by the fastener. It should be noted that when the connection member 31 is pulled in, the clip 33 should only be clipped to the adjuster 19.

Figure 1:
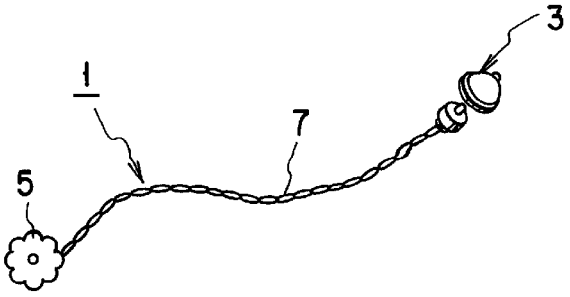
FIG. 1 (PRIOR ART)
FIG. 1 is a perspective view showing a conventional headgear blow-away preventing device.
Figure 3:
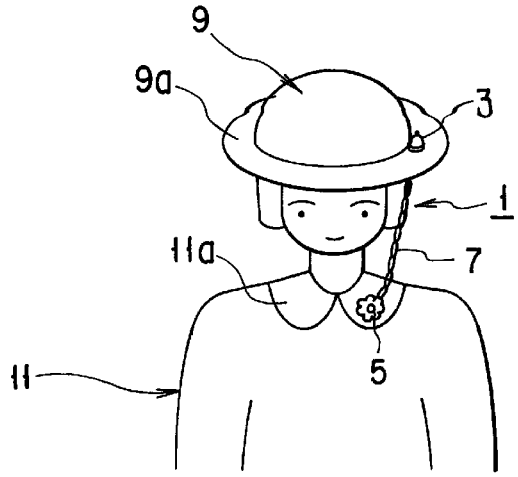
FIG. 3 (PRIOR ART)
FIG. 3 is a perspective view illustrating how to use the headgear blow-away preventing device shown in FIG. 1 while it is clipped onto a hat.
Figure 2:
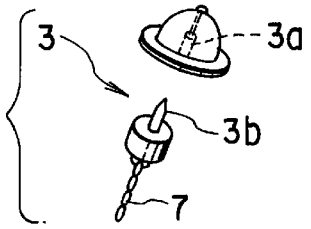
FIG. 2 (PRIOR ART)
FIG. 2 is a perspective view showing an enlarged view of a part of the headgear blow-away preventing device shown in FIG. 1.
Figure 4:
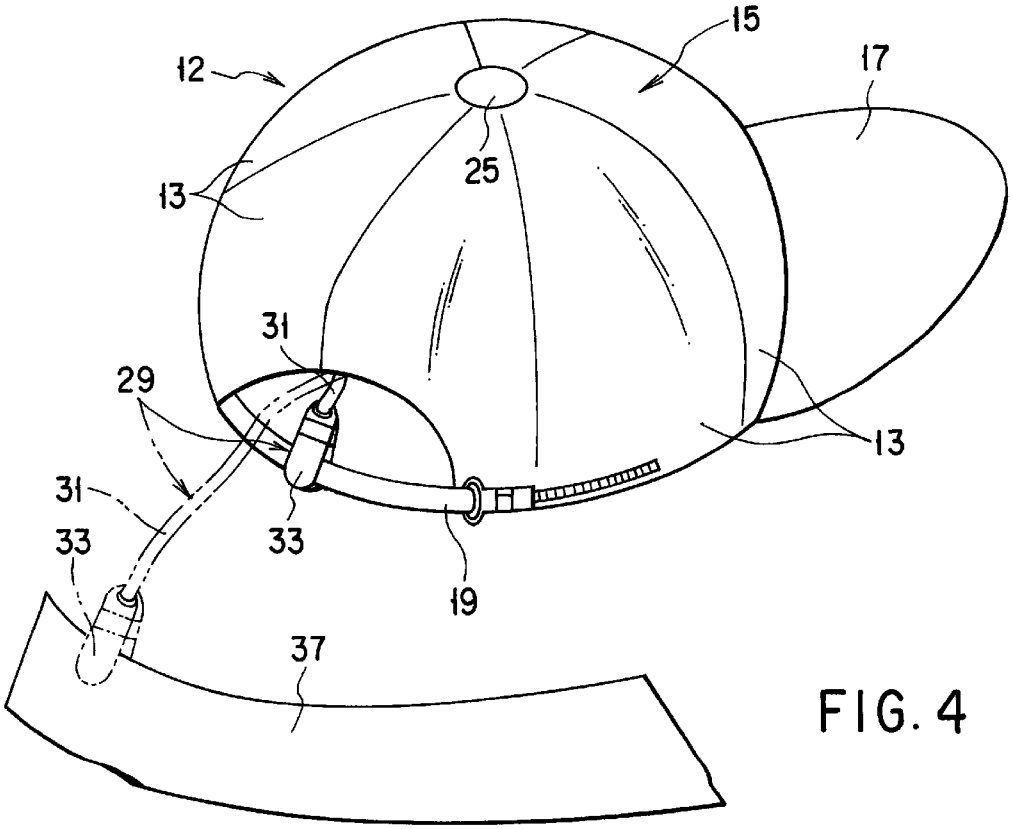
FIG. 4 is a perspective view showing a cap according to a first embodiment of the present invention when viewed from behind.

As to the cap 12 having the above-described structure, when it is used in a windy situation, the connection member 31 is extended and the clip 33 is clipped to the collar of the wearer as shown in FIG. 4. In this manner, even if the cap 12 is removed by wind, the connection member 31 serves to prevent the cap from being blown away. When the headgear blow-away preventing device 29 is not necessary, the clip 33 is clipped onto the adjuster 19 and the connection member 31 pulled into the crown 15 is held by the fastener 35, as indicated in FIG. 4 by a solid line as well as in FIG. 7.

Therefore, when the blow-away preventing device 29 is not used, the connection member 31 and the clip 33 do not become obstructive. Further, the connection member is contained inside the crown, and therefore the fashionable style of the cap as a whole is maintained. The connection member 31 is integrally fixed to the top button 25 in the crown 15 and put through the insertion through portion 27, so that it does not fall out if the connection member is pulled. With this structure, the headgear blow-away preventing device 29 will not be lost or forgot to be brought with. Further, when the blow-away preventing device is not used, the connection member pulled preventing the crown is held by the fastening member, and therefore the connection member can be securely stored and maintained.

Further, with the above-described structure of the headgear blow-away preventing device, the device can be easily applied to conventional caps. At the same time, as compared to the conventional strap, there is only one clip required, which makes it possible to keep the production cost low.

It should be noted that the above-described embodiment has a structure in which one end of the connection member 31 is fixed to the top button 25, as a mechanism for avoiding the falling-out of the member 31. However, it is possible that the connection member is not fixed to the top button 25, but one end of the connection member 31 is tied into a knot which is so large that it cannot go through the insertion through portion 27, or a stopper portion having such a size which cannot go through the insertion through portion is provided at one end of the connection member, so as to integrally mount the headgear blow-away preventing device to the crown. Further, the connection portion may be formed into a tape-like shape in place of a string.

Figure 8:
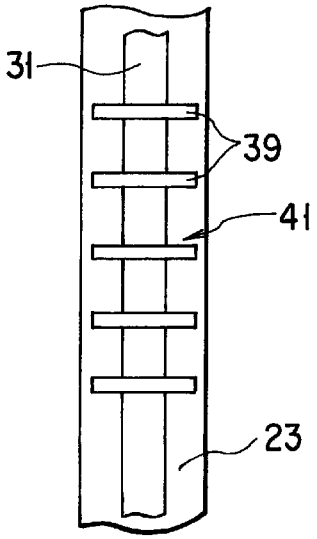
FIG. 8 is a view showing an alternative version of a insertion through portion through which a connection portion of the headgear blow-away preventing device is put.
Figure 9:
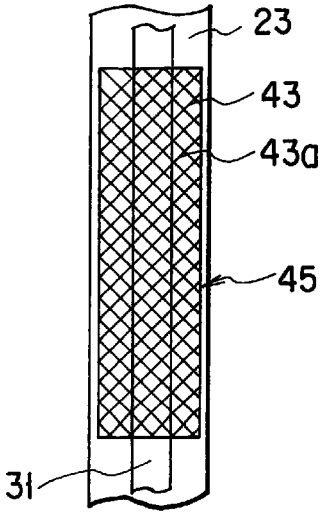
FIG. 9 is a view showing another alternative version of the put-through section.
Figure 10:
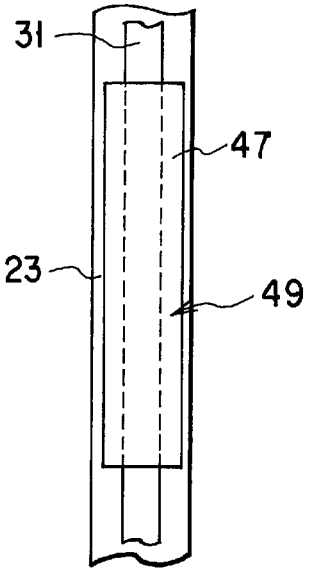
FIG. 10 is a view showing still another alternative version of the put-through section.

FIGS. 8 to 10 are figures showing alternative versions of the insertion through portion described above.

In the alternative version shown in FIG. 8, a plurality of strips 39 are provided on the tape 23 to be parallel to each other so as to cross the connection member 31, and thus an insertion through portion 41 of the blow-away preventing device 29 is formed. In the alternative version shown in FIG. 9, a slender thread 43*a* is woven in a cross manner to form a rectangular-shaped net 43, and such a net is stitched onto the tape 23, to make an insertion through portion 45 of the blow-away preventing device 29. In the alternative version shown in FIG. 10, a flat pipe 47 made of a soft resin is fixed onto the tape 23 by sewing, thus forming an insertion through portion 49 of the blow-away preventing device 29. With these alternative examples, it is possible to obtain similar effects to those of the embodiment shown in FIGS. 4 to 7. In these alternative versions, the structures other than the insertion through portion are similar to those of the embodiment shown in FIGS. 4 to 7, and therefore the descriptions for these structures will not be repeated.

Figure 11:
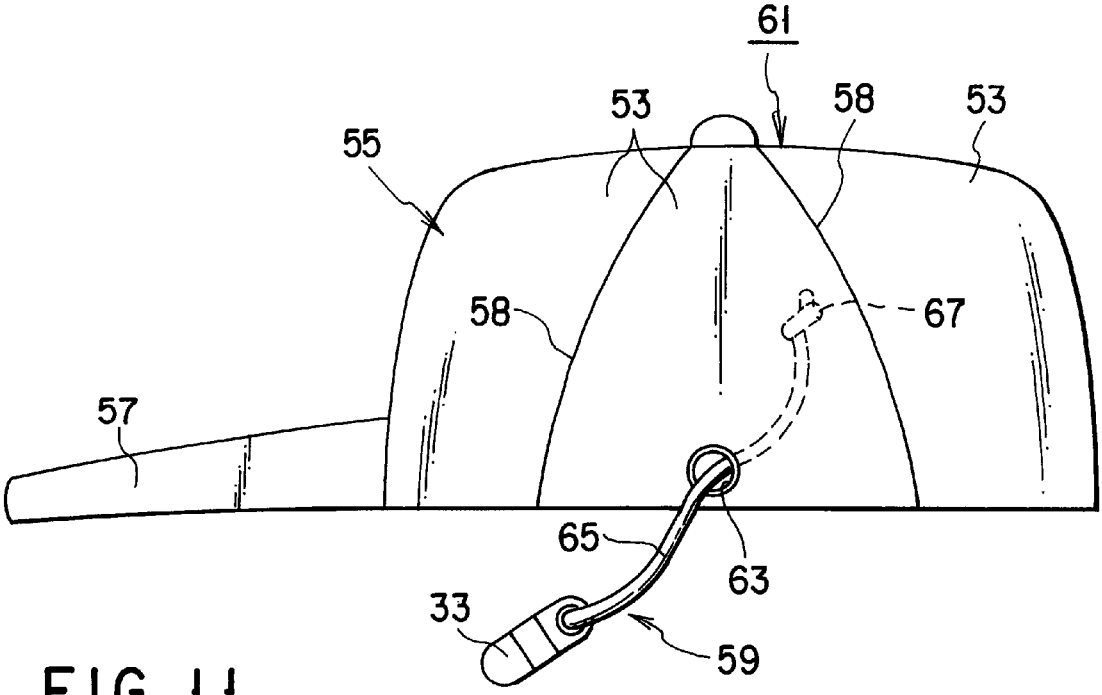
FIG. 11 is a side view showing a cap according to the second embodiment of the present invention.

FIG. 11 is a side view showing a cap according to the second embodiment of the present invention.

A cap 61 has a crown 15 made by sewing a plurality of material cloth pieces 53 together, and a sunshade 57 is mounted to a front lower edge section of the crown 55. Further, inside the crown 55, tapes (not shown) are stitched along seams 58 of the cloth pieces 53, so as to maintain the shape of the crown 55.

A headgear blow-away preventing device 59 of this embodiment has a cloth string (connection member) 65 put through a hole (insertion through portion) 63 made in a side surface portion of the crown 55, and a clip 33 provided on one end of the string 65. The other end of the string 65 is tied into a knot 67 so large that cannot go through the hole 63. Further, inside the crown 55, a fastener (not shown here) such as shown in FIG. 5 is provided. When the headgear blow-away preventing device 59 is not used, the string 65 is pulled into the crown from the knot side and held by the fastener.

As to the cap of this embodiment, when it is used in a windy situation, the string 65 is extended and the clip 33 is clipped to the collar of the wear. In this manner, the cap 61 is not blown away by wind. When the headgear blow-away preventing device 59 is not necessary, the string 65 is pulled into the crown 55 from the knot side, and is held by the fastener. Therefore, the string 65 and the clip 33 do not become obstructive. Further, the string 65 is contained inside the crown 55, and therefore the fashion mode of the cap as a whole is maintained. With this structure, the headgear blow-away preventing device 59 will not be lost or forgot to bring with. Additionally, as compared to the conventional strap, there is only one clip required, which makes it possible to maintain the production cost low.

Figure 12:
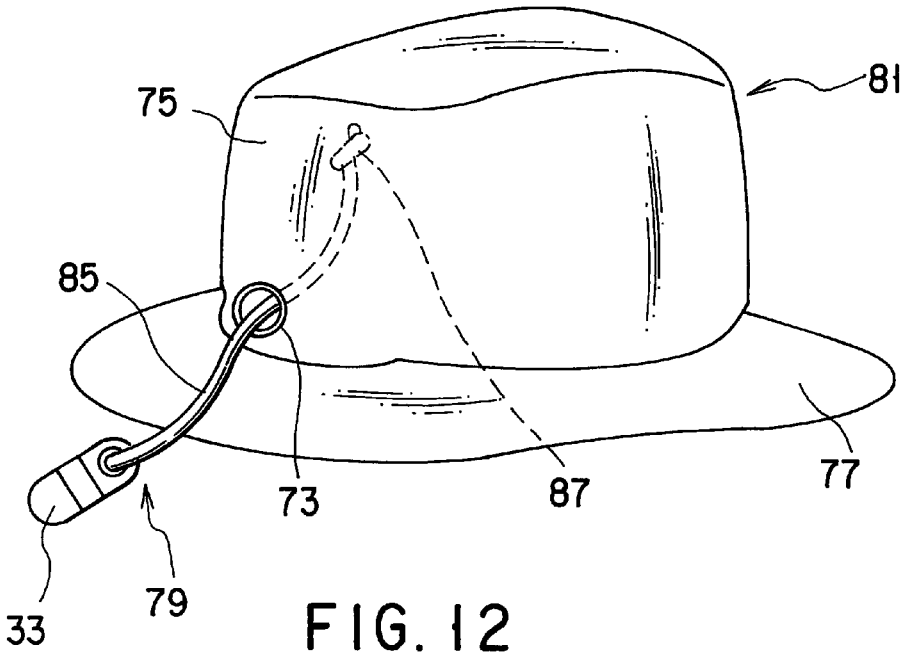
FIG. 12 is a perspective view showing a hat according to the third embodiment of the present invention.

FIG. 12 is a side view showing a hat according to the third embodiment of the present invention.

A hat 81 has a crown 75 and a brim 77 mounted to the lower edge portion of the crown 75. At the lower section of the rear portion of the crown 75, a hole 73 (insertion through portion) is made as in the case of the second embodiment described before. A headgear blow-away preventing device 79 of this embodiment has a cloth-made string (connection member) 85 put through the hole 73, and a clip 33 provided on one end of the string 85. The other end of the string 85 is tied into a knot 87 so large that cannot go through the hole 73. Further, inside the crown 75, a fastener (not shown here) such as shown in FIG. 5 is provided. When the headgear blow-away preventing device 79 is not used, the string 85 is pulled into the crown 75 from the knot side and held by the fastener.

As to the hat of this embodiment, the hat 81 is not blown away even if it is removed from the head by wind. When the headgear blow-away preventing device 79 is not necessary, the string 85 is held by the fastener in the crown 75. Therefore, the string 85 and the clip 33 do not become obstructive. Further, the string 85 is contained inside the crown 75, and therefore the fashion mode of the hat as a whole is maintained. With this structure, the headgear blow-away preventing device 79 will not be lost or forgot to bring with. Additionally, as compared to the conventional strap, there is only one clip required, which makes it possible to maintain the production cost low.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A headgear, comprising;

a crown having an outer side and an inner side, and adapted to be put on a wearer's head, and having an insertion-through portion disposed on the inner side of the crown; and a headgear blow-away preventing device including a connection member having an end provided with a clip for clipping to the wearer, and wherein another end of the connection member has a stopper mechanism for preventing the connection member from failing out of the insertion-through portion of the crown.

2. A head gear according to claim 1, wherein the crown is formed by sewing a plurality of material cloth pieces together, and the insertion through portion is provided on a tape stitched along a seam of the material cloth pieces.

3. A headgear according to claim 1, wherein the stopper mechanism includes the other end of the connection member fixed to a position inside the crown.

4. A headgear according to claim 1, wherein the stopper mechanism has a stopper portion made at the other end of the connection member and which is larger than a size of the insertion through portion.

5. A headgear according to claim 1, wherein a holding member is provided on the inner side of the crown, for holding the connection member when the connection member is pulled into the crown.

6. A headgear according to claim 5, wherein the holding member is a fastener mounted inside the crown and can hold the connection member by clipping.

* * * * *